US007611607B2

(12) United States Patent
Mullally et al.

(10) Patent No.: US 7,611,607 B2
(45) Date of Patent: Nov. 3, 2009

(54) RIPPLED PAPERMAKING FABRICS FOR CREPED AND UNCREPED TISSUE MANUFACTURING PROCESSES

(75) Inventors: Cristina Asensio Mullally, Neenah, WI (US); Brooke Savell, Brandon, MS (US)

(73) Assignee: Voith Patent GmbH, Heidenheim (DE)

( * ) Notice: Subject to any disclaimer, the term of this patent is extended or adjusted under 35 U.S.C. 154(b) by 411 days.

(21) Appl. No.: 11/553,906

(22) Filed: Oct. 27, 2006

(65) Prior Publication Data

US 2008/0110591 A1 May 15, 2008

(51) Int. Cl.
*D21F 1/10* (2006.01)
*D21F 7/12* (2006.01)

(52) U.S. Cl. ..... 162/348; 162/116; 162/902; 162/903; 442/206

(58) Field of Classification Search ..... 162/109–117, 162/348, 358.1, 358.2, 361, 900–904; 428/152–154, 428/174, 220; 139/383 A, 383 AA, 425 A; 442/205–207
See application file for complete search history.

(56) References Cited

U.S. PATENT DOCUMENTS

| | | | | | |
|---|---|---|---|---|---|
| 3,905,863 | A * | 9/1975 | Ayers | 162/113 |
| 4,161,195 | A | 7/1979 | Khan | 139/383 |
| 4,239,065 | A | 12/1980 | Trokhan | 139/383 |
| 4,528,239 | A | 7/1985 | Trokhan | 428/247 |
| 4,637,859 | A | 1/1987 | Trokhan | 162/109 |
| 4,849,054 | A | 7/1989 | Klowak | 162/109 |
| 5,228,482 | A | 7/1993 | Fleischer | 139/383 |
| 5,429,686 | A | 7/1995 | Chiu et al. | 139/383 |
| 5,542,455 | A * | 8/1996 | Ostermayer et al. | 139/383 A |
| 5,672,248 | A | 9/1997 | Wendt et al. | 162/109 |
| 5,819,811 | A * | 10/1998 | Baker et al. | 139/383 AA |
| 5,832,962 | A | 11/1998 | Kaufman et al. | 139/383 |
| 5,839,479 | A * | 11/1998 | Gulya et al. | 139/383 A |
| 5,853,547 | A * | 12/1998 | Ahrens et al. | 162/348 |
| 6,237,644 | B1 | 5/2001 | Hay et al. | 139/383 |
| 6,287,426 | B1 | 9/2001 | Edwards et al. | 162/281 |
| 6,592,714 | B2 | 7/2003 | Lamb | 162/116 |
| 6,649,026 | B2 | 11/2003 | Lamb | 162/348 |
| 6,673,202 | B2 * | 1/2004 | Burazin et al. | 162/109 |
| 6,998,024 | B2 | 2/2006 | Burazin et al. | 162/358.2 |
| 2005/0236122 | A1 | 10/2005 | Mullally et al. | 162/109 |
| 2006/0090867 | A1 | 5/2006 | Hermans et al. | 162/111 |
| 2006/0182936 | A1 | 8/2006 | Payne et al. | 428/195.1 |
| 2007/0095415 | A1 * | 5/2007 | Hodson et al. | 139/383 A |

FOREIGN PATENT DOCUMENTS

| | | |
|---|---|---|
| WO | WO98/53138 | 11/1998 |

* cited by examiner

*Primary Examiner*—Eric Hug
(74) *Attorney, Agent, or Firm*—Taylor & Aust, P.C.

(57) ABSTRACT

A woven fabric for a papermaking machine includes a textured sheet contacting surface having substantially continuous machine-direction ripples separated by valleys. The ripples are formed of multiple warp strands grouped together and supported by multiple shute strands of two or more diameters.

30 Claims, 10 Drawing Sheets

RIPPLED PAPERMAKING FABRICS FOR CREPED AND UNCREPED TISSUE MANUFACTURING PROCESSES

BACKGROUND OF THE INVENTION

1. Field of the Invention

The present invention relates to papermaking machines, and, more particularly, to fabrics used in papermaking machines.

2. Description of the Related Art

In the manufacturing of tissue products, particularly absorbent tissue products, there is a continuing need to improve the physical properties of the tissue and offer a differentiated product appearance. It is generally known that molding a partially dewatered celluslosic web on a topographical papermaking fabric will enhance the finished paper product's physical properties. Such molding can be applied by fabrics in an uncreped through air dried process as disclosed in U.S. Pat. No. 5,672,248 to Wendt et al, or in wet pressed tissue manufacturing processes as disclosed in U.S. Pat. No. 4,637,859 to Trokhan, U.S. Pat. No. 4,849,054 to Klowak, U.S. Pat. No. 6,287,426 to Edwards et al., or US patent application US 2006/0090867 A1 by Herman et al.

Wet molding typically imparts desirable physical properties independent of whether the tissue is subsequently creped as disclosed in US patent application 2006/0090867 A1, or an uncreped tissue product is produced. Hence, it is generally desirable to continuously improve the papermaking fabric's topography for improved molding characteristics, tissue structure, and tissue crepability.

U.S. Pat. No. 4,161,195 to Khan refers to papermaking fabrics which are 5-shed or greater and woven in non-regular twill patterns such that the warp and shute yarns have an "evensided" amount of interlacings in each unit weave repeat and no knuckle exceeds more than three crossovers in length. Generally the MD and CD knuckles are coplanar in the top surface plane of the fabric, although this is not a requirement. The fabrics have relatively short warp floats passing over no more than three shutes and little overlap of the MD knuckles.

U.S. Pat. No. 5,832,962 to Kaufman and Herman describe warp dominant TAD fabrics containing a first axis of bulky ridges defined by long warp knuckles on adjacent threads oriented at 68 to 90 degrees from the CD and a second axis formed by the long warp knuckles with other overlapping long warp knuckles on nearby warp threads with an angle of less than 23 degress from the CD. The fabric ridges are no higher than the height of a single warp strand since they are based on adjacent warp yarns which overlap in the machine direction but not in the z-direction. The ridges are located on a bias with respect to the MD due to their overlapping construction. Example fabrics have at least 4 interlacings in a unit weave repeat, at least 3 breaks, lateral yarn crimp, and are 9-shed or greater.

U.S. Pat. No. 5,429,686 to Chiu et al. discloses a through air drying fabric with a distinct load-bearing woven fabric layer and an additional sculpture layer formed by additional long-floated machine direction yarns, with the floats standing proud of the main body of the load-bearing fabric layer to shape the formed sheet.

U.S. Pat. No. 4,239,065 describes fabrics having "wicker-basket-like cavities" staggered in both MD and CD. Coplanar top surface knuckles surround the cavities, which span sub-top-surface crossovers or knuckles. The pickets surrounding the cavities are imprinted into the sheet in a wet-pressed papermaking operating. U.S. Pat. Nos. 6,592,714 and 6,649,026 to Lamb describe larger cavities than Trokhan wherein the cavities contain warp and shute interlacings. The cavities are dimensioned by pocket depths measured between two planes internal to the fabric structure.

Additional fabrics are described in U.S. Pat. No. 5,228,482 to Fleischer which offer interconnected pockets instead of Trokhan's discrete cavities based on a top-surface plane of MD knuckles with a sub-top-surface plane of CD knuckles and a lower sup-top-surface plane of MD knuckles.

U.S. Pat. No. 6,237,644 B1 to Hay et al. describe fabrics having a continuous lattice separating woven areas with at least three yarns in MD and CD.

U.S. Pat. No. 6,998,024 B2 to Burazin et al. disclose papermaking fabrics with substantially continuous machine direction ridges whereby the ridges are made up of multiple warp strands grouped together. The ridges are higher and wider than individual warps. The wide wale ridges have a ridge width of about 0.3 cm or greater and the frequency of occurrence of the ridges in the CD is from about 0.2 to 3 per centimeter. In the examples shown, the shute diameters are both larger than or smaller than the warp diameters but only one shute diameter is utilized.

US patent application US 2005/0236122 A1 by Mullally et al. disclose woven papermaking fabrics which have deep, discontinuous pocket structures with a regular series of distinct, relatively large depressions in the fabric surface surrounded by raised warp or raised shute strands. The pockets could be of any shape, with their upper edges on the pocket sides being relatively even or uneven, but the lowest points of individual pockets are not connected to the lowest points of other pockets. The most common examples are all waffle-like in structure and could be warp dominant, shute dominant, or coplanar. The pocket depths can be from about 250 to about 525 percent of the warp strand diameter.

Additional patents cover materials adhered to the surface of either a flat or topographical fabric such as the application of a resinous framework or polymer pattern onto the sheet-contacting side of the fabric as described in U.S. Pat. No. 4,528,239 to Trokhan, EP 988,419 B1 to Huston, U.S. Pat. No. 6,398,910 B1 to Burazin and Chiu, or US patent application US 2006/0182936 A1 to Payne et al.

What is needed in the art is a papermaking fabric with improved runnability on the papermachine, for example, by improving vacuum operating windows, improving sheet adhesion to a Yankee dryer to improve creping and drying, reducing through air drying loads by eliminating pinholes, or improving fabric life through increased fabric robustness or reduced wear. What is also needed in the art is a papermaking fabric offering improved topography to allow increased tissue bulk.

SUMMARY OF THE INVENTION

The present invention provides a fabric capable of delivering improved tissue bulk and other tissue physical properties as well as improved machine runnability. Papermaking fabrics of the current invention are limited to woven fabrics but may be suitable as base fabrics upon which to add additional material to enhance tissue physical properties or aesthetics.

Novel weave techniques were used to develop additional narrow wale papermaking fabrics which offer improved fabric stiffness, improved towel bulk (fabric Fred), and improved fiber support for bath (fabric Jack) when used as through air drying (TAD) fabrics. These fabrics are also able to be run as TAD fabrics in a creped applications such as conventional through air dried tissue machines to generate aesthetically acceptable ripples and good, bulky tissue attributes. These fabrics are also able to be run as impression fabrics in wet pressed papermaking processes as disclosed in U.S. Pat. No. 6,287,426 to Edwards et al.

In one aspect, the invention resides in a woven papermaking fabric having a textured sheet contacting surface with substantially continuous machine-direction ripples separated by valleys, the ripples being formed of multiple warp strands grouped together and supported by multiple shute strands of two or more diameters; wherein the width of ripples is from about 1 to about 5 millimeter, more specifically about 1.3 to 3.0 millimeter, still more specifically 1.9 to 2.4 mm; and the frequency of occurrence of the ripples in the cross-machine direction of the fabric is from about 0.5 to 8 per centimeter, more specifically 3.2 to 7.9, still more specifically 4.2 to 5.3 per centimeter. These fabrics will be referred to as narrow-wale rippled fabrics hereafter. The rippled channel depth, which is the z-directional distance between the top plane of the fabric and the lowest visible fabric knuckle that the tissue web may contact, can be from about 0.7 to about 1.6, more specifically about 0.8 to about 1.1 millimeters, more specifically from about 0.8 to about 1.0 millimeters, and still more specifically from about 0.85 to about 1.0 millimeters. (For purposes herein, a "knuckle" is a structure formed by overlapping warp and shute yarns.) For purposes herein, the lowest visible fabric knuckle becomes the over-1-shute warp knuckle within the fabric valleys.

Each individual warp strand can concurrently participate in both the structure of the ripples and the structure of the valleys. In another embodiment of the present invention, the ripples can include multiple individual warp strands substantially oriented in a machine direction, and each individual warp strand can concurrently participate in both the structure of the ripples and the structure of the valleys.

In another aspect of the invention, the use of multiple shute diameters and modified weave structures enable rippled channel depths (hereinafter defined) from about 250 to about 300 percent of the warp strand diameter, more specifically from about 260 to about 290 percent, or from about 105 to about 120 percent of the sum of the warp and weighted-average shute diameters.

In another aspect of the invention, the use of multiple shute diameters and modified weave structures have improved fabric stiffness of almost 80% over prior art single layer structures, which provides improved fabric rigidity to withstand process upsets on the paper machine as well as increased robustness for multiple fabric installations and mechanical wear. The cross-machine bending stiffness for the fabrics of the present invention can be from about 20 to about 80 N·m, more specifically from about 25 to about 50 N·m, and still more specifically from about 30 to about 40 N·m.

In another aspect of the invention, fabrics of the invention provide improved tissue bulk and CD strain levels versus prior art structures of similar fabric ripple width while simultaneous ensuring acceptable levels of fiber support as measured by pinhole standards.

The invention in one form is directed to a woven papermaking fabric having a textured sheet contacting surface comprising substantially continuous ripples aligned at an angle to the machine direction of the fabric and separated by valleys, said ripples being formed of multiple warp strands grouped together and supported by multiple shute strands of two or more diameters, wherein the warp strands are substantially oriented in the machine direction and wherein each individual warp strand participates in both a structure of said ripples and a structure of said valleys.

The invention in another form is directed to a woven fabric for a papermaking machine. The fabric includes a textured sheet contacting surface having substantially continuous machine-direction ripples separated by valleys. The ripples are formed of multiple warp strands grouped together and supported by multiple shute strands of two or more diameters.

The invention in yet another form is directed to a woven papermaking fabric having a textured sheet contacting surface including substantially continuous ripples aligned at an angle to the machine direction of the fabric and separated by valleys. The ripples are formed of multiple warp strands grouped together and supported by multiple shute strands of two or more diameters, wherein the warp strands are substantially oriented in the machine direction and wherein each individual warp strand participates in both a structure of the ripples and a structure of the valleys.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, in one form, and such exemplifications are not to be construed as limiting the scope of the invention in any manner.

DETAILED DESCRIPTION OF THE INVENTION

Figure 1:
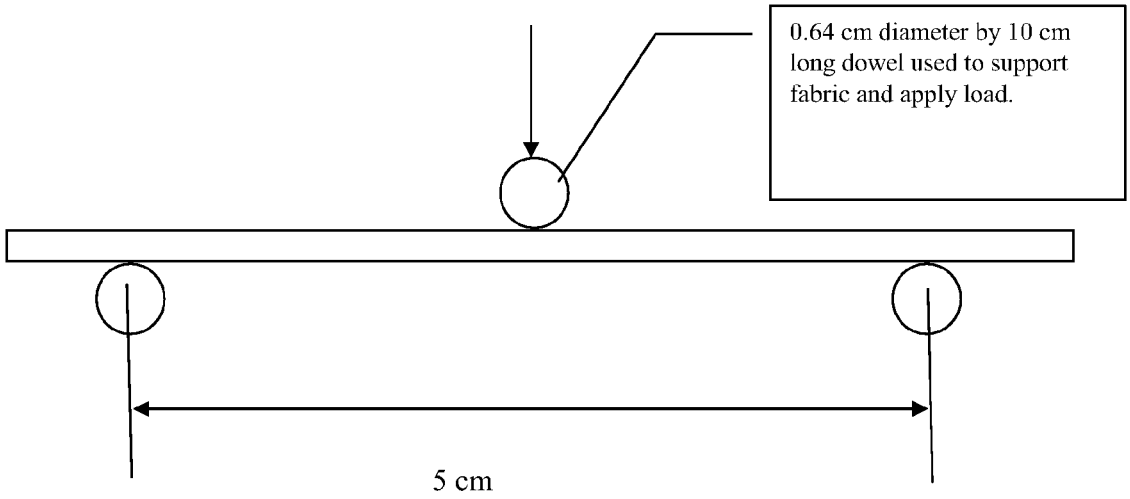
FIG. 1 is a schematic plan view of a three-point bending stiffness test apparatus.

As used herein, the term "papermaking fabric" means any woven fabric used for making a cellulose web such as a tissue sheet, either by a wet-laid process or an air-laid process. Specific papermaking fabrics within the scope of this invention include forming fabrics; transfer fabrics conveying a wet web from one papermaking step to another, such as described in U.S. Pat. No. 5,672,248 to Wendt et al.; as a molding, shaping, or impression fabrics where the web is conformed to the structure through pressure assistance and conveyed to another process step, as described in Wendt et al., US patent application US 2006/0090867 A1 to Herman et al., or U.S. Pat. No. 6,287,426 to Edwards et al.; as creping fabrics as described in US 2005/0241786 A1 to Edwards et al.; as embossing fabrics as described in U.S. Pat. No. 4,849,054 to Klowak; as a structured fabric adjacent a wet web in a nip as described in US patent application US 2006/0085998 A1; or as a through-air drying fabric as described in Wendt et al., U.S. Pat. No. 5,429,686 to Chiu et al., and U.S. Pat. No. 6,808,599 B2 to Burazin et al. for un-creped processes or U.S. Pat. No. 6,039,838 to Kaufman & Herman for creped processes. The fabrics of the invention are also suitable for use as molding or air-laid forming fabrics used in the manufacture of non-woven, non-cellulosic webs such as baby wipes.

Fabric terminology used herein follows naming conventions familiar to those skilled in the art. For example, warps are typically machine-direction yarns and shutes are cross-machine direction yarns, although it is known that fabrics can be manufactured in one orientation and run on a paper machine in a different orientation. As used herein, "warp dominant" fabrics have a top plane dominated by warp floats, or MD impression knuckles, passing over 2 or more shutes. There are no cross-machine direction knuckles in the top plane. Examples of warp dominant fabrics can be found in U.S. Pat. No. 5,746,887 to Wendt et al., U.S. Pat. No. 5,429,686 to Chiu et al, U.S. Pat. No. 5,832,962 to Kaufman & Herman. Simple dryer or conveying fabrics containing only 1 or 2 unique warp paths per unit cell of the weave pattern and in which a significant portion of all warp floats rise to the same top plane, such as shown in U.S. Pat. No. 4,161,195 to Khan are considered to be "warp co-planar". Examples of commercially available warp co-planar dryer fabrics are the Voith Fabrics "Onyx" and Voith Fabrics "Monotex II Plus" designs. The 5-shed granite weave of Khan is a well known fabric, 44GST, used in through air drying, currently sold under the tradenames Albany ProLux 003, Voith Fabrics TissueMax G, or Asten-Johnson MonoShape G, and provides pocket depths, measured between the top plane of the fabric and the highest point of the shute knuckles, of approximately 50% of the warp yarn diameter.

As used herein, "shute dominant" fabrics have a top plane dominated by shute floats, or CD impression knuckles, passing over 2 or more warps. There are no machine direction knuckles in the top plane. "Coplanar" fabrics have a top plane containing both warp floats and shute floats which are substantially co-planar. A basic 5-shed broken twill or satin-weave pattern like the historic M weave which is widely used in the industry as a TAD fabric, currently sold under the tradenames of Albany ProLux 005, Voith TissueMax M or Asten-Johnson MonoShape M, is an example of a fabric which can be either warp coplanar, when oriented so that the long warp knuckles are facing the web, or warp & shute coplanar depending upon how it is heatset. For the purposes of this invention, co-planar fabrics have knuckle heights (hereinafter defined) above the intermediate plane (hereinafter defined) less than 8% of the combined sum of average warp and shute diameters. Alternatively, co-planar fabrics have bearing areas (hereinafter defined) which are less than 5% at the intermediate plane. The fabrics of this invention can be warp dominant, shute dominant, or coplanar. Persons skilled in the art are aware that changing weaving parameters such as weave pattern, mesh, count, or yarn size as well as heat setting conditions can affect which yarns form the highest plane in the fabric.

As used herein, "intermediate plane" is defined as the plane formed by the highest points of the perpendicular yarn knuckles. For warp dominant fabrics, the intermediate plane is defined as the plane formed by the highest points of the shute knuckles, as in Wendt et al. and Chiu et al. For shute dominant fabrics, the intermediate plane is defined as the plane formed by the highest points of the warp knuckles. There is no intermediate plane for co-planar structures.

As used herein, the "valley bottom" is defined by the top of the lowest visible yarn which a tissue web can contact when molding into the textured side of the fabric having substantially continuous machine-direction ripples separated by valleys. Only yarn elements which are at least as wide as they are long were considered when visually defining the z-direction plane intersecting the valley bottom with profilometry software. The valley bottom can be defined by a warp knuckle, a shute knuckle, or by both. The "valley bottom plane" is the z-direction plane intersecting the top of the elements comprising the valley bottom.

As used herein, the fabric "knuckle height" is defined as the distance from the top plane of the fabric to another specified z-direction plane in the fabric, such as the intermediate plane or the valley bottom. The fabrics of this invention are characterized by deep, rippled structures, in which "deep" means a z-direction height greater than one warp yarn diameter and in which "rippled" denotes that individual fabric valleys available for molding into are separated from adjacent valleys by the substantially continuous machine direction ripples comprised of raised warps. For the purposes of this invention, the "rippled channel height" is defined as the distance from the top plane of the fabric to the valley bottom.

As used herein, the term "angled ripples" means that the fabric ripples and valleys can be oriented at an angle of from 0 to about ±15 degrees relative to the true machine direction of the fabric. The fabric ripples are substantially continuous, and not discrete. Accordingly, the alignment or orientation of the ripples and valleys relative to the machine direction yarns of the fabric can be from 0 to about ±15 degrees, more specifically from 0 to about ±10 degrees, still more specifically from 0 to about ±5 degrees, and still more specifically the alignment can be parallel to the machine direction (0 degrees). Furthermore, the alignment or orientation relative to the machine direction can be from about ±5 to about ±15 degrees, and still more specifically from about ±10 to about ±15 degrees. The ripples can be straight or wavy to improve the aesthetic appearance of the tissue sheet. For wavy or otherwise back-and-forth angled ripples, the alignment of the ripples is determined as an overall average direction.

As used herein, "features" are defined as singular knuckles or touching groupings of knuckles which appear within the top plane of the fabric. As used herein, "substantially continuous machine-direction bands" of contact have disruptions or breaks in the contact pattern no larger than 0.7 mm measured in the machine direction.

As used herein, "bearing area" or material ratio DTp, is the amount of area occupied by the fabric material at a depth p below the highest feature of the surface, expressed as a percentage of the assessment area. Bearing areas can be determined from Abboft-Firestone curves, or material ratio curves, via standard metrology.

Furthermore, to be commercially advantaged, it is desirable to minimize the presence of pinholes in the sheet. The degree to which pinholes are present can be quantified by the Pinhole Coverage Index, the Pinhole Count Index and the Pinhole Size Index, all of which are determined by an optical test method known in the art and described in U.S. Pat. No. 6,673,202 B2 entitled "Wide Wale Tissue Sheets and Method of Making Same", granted Jan. 6, 2004, which is herein incorporated by reference.

In the interests of brevity and conciseness, any ranges of values set forth in this specification contemplate all values within the range and are to be construed as support for claims reciting any sub-ranges having endpoints which are whole number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5.

Test Procedures

The three-dimensional topography of fabrics or tissue produced using such fabrics can be determined by various means known to those skilled in the art, including simple photographs of plan views and cross-sections. Surface profilometry is particularly suitable, however, because of its precision. The non-contacting surface profilometry method described is US patent application US 2005/0236122 A1 by Mullally et al. has been utilized to develop a three-dimensional quantitative map of the exposed fabric surfaces and is hereby incorporated by reference. Fabric characteristics and z-direction depth measurements are reported in Table 1 for representative prior art and embodiments in accordance with the invention.

More particularly, for purposes herein, optical surface profilometry can be used to map the three-dimensional topography of the tissue sheets or the fabrics. The three-dimensional optical surface topography maps can be determined using a MicroProf™ measuring system equipped with a CHR 150 N optical distance measurement sensor with 10 nm resolution (system available from Fries Research and Technology GmbH, Gladbach, Germany). The MicroProf measures z-direction distances by utilizing chromatic aberration of optical lenses to analyze focused white light reflected from the sample surface. An x-y table is used to move the sample in the machine direction (MD) and cross-machine direction (CD). MD and CD resolution for most samples can be set at 20 um to ensure at least 10 data points are collected across each yarn diameter, with the finer fabric samples scanned at 10 um x-y resolution.

The three-dimensional surface profilometry maps can be exported from MicroProf in a unified data file format for analysis with surface topography software TalyMap Universal (ver 3.1.10, available from Taylor-Hobson Precision Ltd., Leicester, England). The software utilizes the Mountains® technology metrology software platform (www.digitalsurf.fr) to allow a user to import various profiles and then execute different operators (mathematical transformations) or studies (graphical representations or numeric calculations) on the profiles and present them in a format suitable for desktop publishing.

The resultant Mountain® documents containing the various post-operation profiles and studies can then be printed to a screen-capture software (Snag-It from TechSmith, Okemos, Mich.) and exported into a Microsoft Word document for file sharing.

Within the TalyMap software, operators utilized for different 3-D profiles include thresholding, which is an artificial truncation of the profile at a given altitudes. Specification of the altitude thresholds, or altitudes of horizontal planes intersecting the profile, are derived by visual observation of the fabric material remaining or excluded in the interactive thresholded profile and its corresponding depth histogram showing the statistical depth distribution of the points on the profile. The first thresholding cleans up the image and adjusts the ranges of the depths recorded, yielding the "surface profilometry results" profile which focuses only on the fabric and not any surface dust or tape holding the fabric sample in place. The second thresholding effectively defines the location of the top surface plane of the fabric (highest surface points); the intermediate plane (highest point of the highest shute (CD yarn) knuckles in the load-bearing layer); and the pocket bottom.

Table 1 below shows manufacturing parameters and surface profilometry measurements for various papermaking fabrics.

| Fabric | 44MST | A-J 934 | 44GST | Elmer (t1203-6) | Ironman (t1203-8) | t1205-1 | Jetson (t1207-6) | Fred (t1207-11) | Jack (t1207-12) | Kanga (t1207-13) |
|---|---|---|---|---|---|---|---|---|---|---|
| Finished Mesh (ends/CD in) | 42 | 37.7 | 42 | 31 | 32 | 47 | 78 | 78 | 78 | 77 |
| Finished Count (shutes/MD in) | 36 | 32 | 31 | 32 | 34 | 48 | 39 | 28 | 34 | 33 |

-continued

| Fabric | 44MST | A-J 934 | 44GST | Elmer (t1203-6) | Ironman (t1203-8) | t1205-1 | Jetson (t1207-6) | Fred (t1207-11) | Jack (t1207-12) | Kanga (t1207-13) |
|---|---|---|---|---|---|---|---|---|---|---|
| Warp diameter (mm) | 0.350 | 0.4 | 0.350 | 0.7 | 0.7 | 0.45 | 0.33 | 0.33 | 0.33 | 0.33 |
| Shute diameter (mm) | 0.41 | 0.4 | 0.45 | 0.6 | 0.6 | 0.6 | 0.4 | 0.4 + 0.6 | 0.4 + 0.6 + 0.3 | 0.4 + 0.6 |
| Weighted avg Shute diameter (mm) | 0.41 | 0.4 | 0.45 | 0.6 | 0.6 | 0.60 | 0.4 | 0.5 | 0.46 | 0.5 |
| Warp density | 58% | 59% | 58% | 67% | 88% | 83% | 101% | 101% | 101% | 100% |
| Shute density | 58% | 50% | 55% | 36% | 80% | 113% | 61% | 55% | 62% | 65% |
| shed | 5 | 5 | 5 | 12 | 12 | 12 | 12 | 12 | 12 | 12 |
| pick | 5 | 5 | 5 | 8 | 9 | 10 | 8 | 8 | 10 | 32 |
| # knuckles/unit cell | 5 | 5 | 5 | 2 | 2 | 2 | 2 | 2 | 2 | 8 |
| # unit cells/in2 | 60.5 | 48.3 | 52.1 | 10.3 | 10.1 | 18.8 | 31.7 | 22.8 | 22.1 | 6.6 |
| Fabric features or protrusions per sq inch | 302.4 | 241.3 | 260.4 | 20.7 | 20.1 | 37.6 | 63.4 | 45.5 | 44.2 | 52.9 |
| Highest yarn in structure (warp or shute) | w | s | w | w | w | w | w | w | w | w |
| No. fabric layers (single or double) | s | s | s | s | s | d | s | s | s | s |
| Fabric CD bending stiffness (N * mm) | 15.8 | 13.4 | 18.8 | 62.6 | 83 | 237 | 13.7 | 34.8 | 32.7 | 21.9 |
| From top plane to Intermediate plane | | | | | | | | | | |
| Knuckle height to intermediate (mm) | 0.011 | 0.099 | 0.177 | 0.466 | 0.073 | 0.513 | 0.298 | 0.406 | 0.378 | .376 |
| Knuckle height to intermediate (% of warp diameter) | 3% | 25% | 51% | 67% | 10% | 114% | 90% | 123% | 115% | 114% |
| Knuckle height (% warp + shute diameters) | 1% | 12% | 22% | 36% | 6% | 49% | 41% | 49% | 48% | 45% |
| From top plane to pocket bottom (lowest visible yarn) | | | | | | | | | | |
| Knuckle height (mm) | 0.011 | 0.099 | 0.177 | 1.590 | 1.340 | 0.907 | 0.720 | 0.879 | 0.927 | 0.993 |
| Knuckle height (% warp diameter) | 3% | 25% | 51% | 227% | 191% | 202% | 218% | 266% | 281% | 301% |
| Knuckle height (% warp + shute diameters) | 1% | 12% | 22% | 122% | 103% | 86% | 99% | 106% | 117% | 120% |

The fabric bending stiffness in the cross-machine direction is an advantageous indicator of the fabric's robustness and ability to withstand upset process conditions on a tissue machine such as thermal shocks or multiple fabric installations. Fabrics having a low stiffness will easily buckle and may fold over on itself during machine operation or even fabric manufacturing, creating a hard wrinkle in the fabric which leads to sheet defects or breaks. The method used to determine the three-point, fabric bending stiffness reported in Table 1 is as follows. The testing procedure is equally suitable for measuring the bending stiffness of other relatively planar structures such as tissue.

The instrument used is an Alliance RT1 Tensile Frame coupled with the simple apparatus shown in FIG. 1. The data acquisition software is MTS TestWorks® for Windows Ver. 3.10 (MTS Systems Corp., Research Triangle Park, N.C.). A 10.2 cm wide (in CD) by 12.7 cm long (in MD) sample is supported on two 0.64 cm diameter, round dowels aligned in the CD and spaced 5 cm apart as shown in FIG. 1. The two support dowels are fixed to the base of the tensile frame. A third 0.64 cm diameter dowel is attached to the moving crosshead of the frame, with the dowel aligned and centered between the two support dowels. At the beginning of the test, the third dowel is brought down at a rate of 2 cm/min, bending the simply supported fabric. The compressive forces applied through the tensile frame to bend the fabric is measured through a 50 N load cell and recorded at a sampling rate of 50 Hz. The amount of fabric deflection away from the moving crosshead is also recorded. The point where the load first exceeds 0.2 N is defined as the zero deflection point. The test continues until a specified deflection depth, in this instance 1 mm, is reached.

The applied force increases linearly with the material deflection for small deflections. A least squares, linear regression of the force versus displacement is used to calculate the slope of the force/displacement curve between 1 mm and 2 mm of deflection. The bending stiffness of the fabric can be determined from basic principles (see for example, Cook, R. D., Young, W. C., Advanced Mechanics of Materials, Macmillan, N.Y., 1985) as:

$$\text{Stiffness} = \frac{L^3 \text{Slope}}{48}$$

where Stiffness is in $N \cdot m^2$, L is the spacing between the supporting points (dowel centerlines) in m, and the Slope is the best fit slope in N/m. The stiffness per unit width, S, is defined as:

$$S = \frac{\text{Stiffness}}{\text{width}}$$

where S is the stiffness per unit width in N·m, and width is in meters. At least three representative specimens are tested for each fabric and the arithmetic average of all individual specimen tests the resultant fabric bending stiffness in the MD or CD direction. For the purposes of this invention, the fabrics have been oriented so that the cross-machine direction of the fabric spans the two support dowels. The width used to normalize the stiffness is therefore the machine-direction width of the fabric sample. The resultant stiffness per unit width, S, is therefore the three-point, cross-machine direction bending stiffness of the fabric in N·m.

As seen in Table 1, prior art conventional, topographical through-air drying fabrics such as 44MST and 44GST offer bending stiffnesses between 13 and 19 N·m. Although the Jetson fabric has almost twice as many warp strands, the rippled fabric structure also results in a low CD bending stiffness due to the low fabric caliper in the fabric valleys and the MD orientation of the ripples. A Jetson fabric has wrinkled when run on a commercial, uncreped, through-air dried tissue machine as a TAD fabric. Simply increasing the amount of cross-machine yarns available to resist bending was not preferable due to the negative impact on fabric permeability, cleaning, and drying. Coarser, wide wale rippled fabrics like Elmer (t1203-6) and Ironman (t1203-8) are stiffer than Jetson due to their larger diameter warps and shutes but also offer correspondingly larger physical ripple dimensions and rippled channel depths. Utilizing a double layer fabric construction like the t1205-1, where an additional fabric layer is added on the machine side to enhance fabric stability and serve as sacrificial wear elements also leads to higher fabric stiffnesses. As transfer fabrics, double layer fabrics can result in fabric cleaning issues; as TAD fabrics they can lead to drying efficiency losses (due to additional heat required to bring the fabric mass up to the drying temperature during each fabric revolution; and as impression fabrics the sheet-side impression contact pattern in the pressure roll/Yankee nip can be adversely affected by the underlying, machine-side layer. Hence, utilization of robust, single layer fabrics is preferred. In the fabrics of the present invention, use of multiple shute diameters and modified weave structures have improved fabric stiffness of almost 80% over prior art single layer structures, The CD bending stiffness for the fabrics of the present invention can be from about 20 to about 80 N·m, more specifically from about 25 to about 50 N·m, and still more specifically from about 30 to about 40 N·m.

Figure 2:
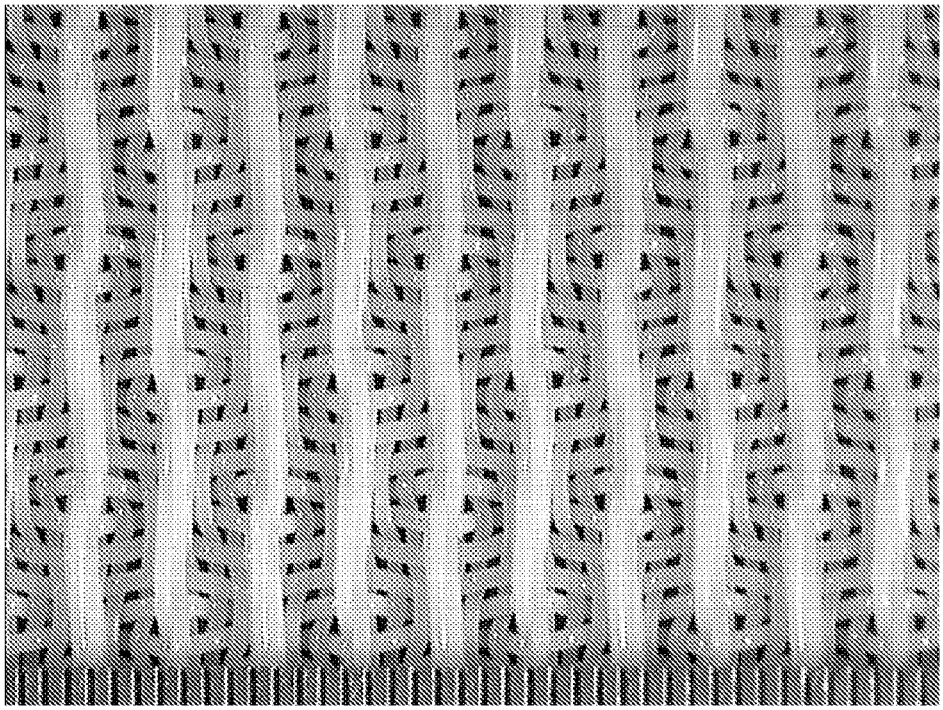
FIG. 2 is a plan view photograph of the sheet contacting side of a Jetson (t1207-6) papermaking fabric.

Referring now to the additional drawings, FIG. 2 is a plan view photograph of the tissue contacting side of a t1207-6 papermaking fabric, which may be used, e.g., as a through-air dryer fabric in US patent application US 2005/0133175 A1 to Hada et al. For photographs in the figures, lighting was provided from the top and side, so that the depressed areas in the fabric are dark and the raised areas are light. For photos including a ruler, the space between each of the vertical lines in the scale at the bottom of the photograph represents 0.5 millimeter.

Figure 3:
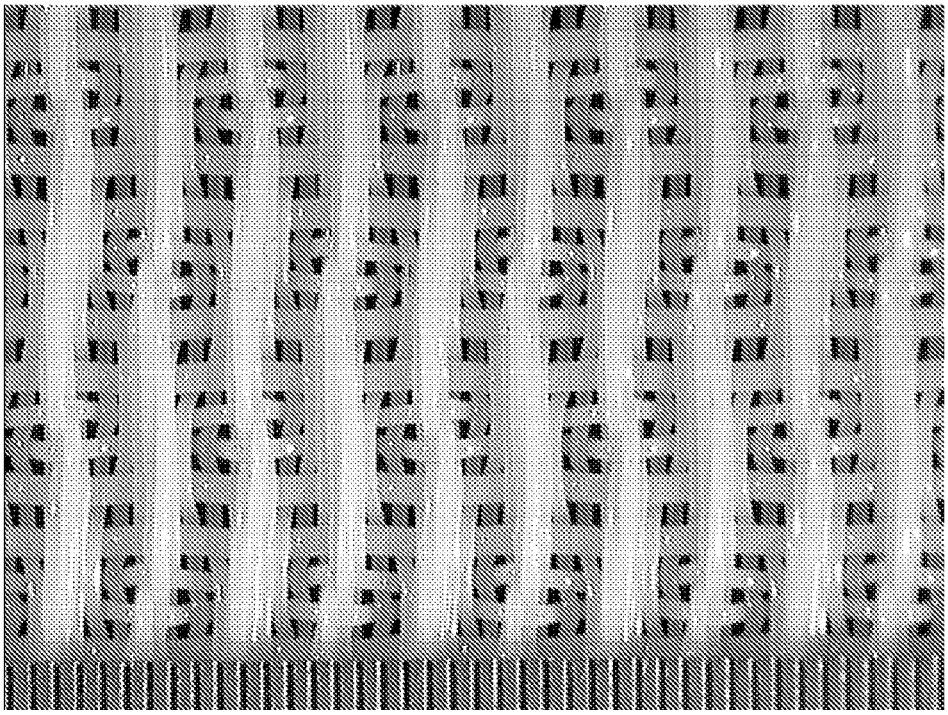
FIG. 3 is a plan view photograph of the sheet contacting side of a Fred (t1207-11) papermaking fabric of the present invention, illustrating the weave pattern and specific locations of the different diameter shutes used to produce the deep, rippled structure.

FIG. 3 is a plan view photograph of the tissue contacting side of the papermaking fabric Fred (t1207-11) of the present invention, illustrating the weave pattern and specific locations of the different diameter shutes used to produce the deep, rippled structure. In this structure, the longest warp float is over seven (7) shutes and two (2) different shute diameters are utilized, both of which are larger than the warp diameter even though this is not a requirement of the fabric structure. The ripples are higher and wider than individual warp strands and individual warp strands participate exclusively in either the fabric ripple or the fabric valley.

The fabric weave structure of the Fred (t1207-12) fabric shown in FIG. 3 as described by the amount and locations of warp and shute interlacings and warp float lengths is identical to the Jetson (t1207-6) weave structure shown in FIG. 2 but selected 0.4 mm shutes are replaced by much larger 0.6 mm shutes. Had all the shutes of the t1207-6 weave structure been increased in size in order to improve bending stiffness, the ripple structure would have semi-collapsed because of the change in the crimp relationship between the shute and warp yarns at the shute interlacing anchoring down the long warp floats. Fabric hole size distribution would also have become worse since the larger shutes would not be able to laterally crimp as well, which would increase the tendency to pull pinholes when tissue is molded into the fabric. With selected use of large diameter shutes in the t1207-12 weave structure, the fabric can be opened up, i.e., manufactured with a lower pick count while still providing the same level of fiber support. This creates a more permeable fabric which improves drying efficiency and fabric cleaning and also a stiffer structure.

The Fred fabric shown in FIG. 3 has a mesh×count of 78 MD ends per inch×34 CD shutes per inch. For transfer, impression, and drying positions, the fabric mesh would suitably be from about 10 to about 150 ends per inch, more preferably from about 30 to about 100 ends per inch, and still more preferably from about 45 to 85 ends per inch. The shute count would suitably be from about 10 to about 80 ends per inch, more preferably from about 20 to about 60 ends per inch, and still more preferably from about 25 to about 40 ends per inch. For forming applications, the fabric mesh would preferably be from about 80 to about 180 warps per inch, and more preferably from about 100 to about 130 ends per inch. The shute count would suitably be from about 40 to about 100 ends per inch, more preferably from about 50 to about 70 ends per inch.

The width of ripples is from about 1 to about 5 millimeter, more specifically about 1.3 to 3.0 millimeter, still more specifically 1.9 to 2.4 mm; and the frequency of occurrence of the ripples in the cross-machine direction of the fabric is from about 0.5 to 8 per centimeter, more specifically 3.2 to 7.9, still more specifically 4.2 to 5.3 per centimeter. The rippled channel depth, which is the z-directional distance between the top plane of the fabric and the lowest visible fabric knuckle that the tissue web may contact, can be from about 0.7 to about 1.6 millimeters, more specifically about 0.8 to about 1.1 millimeters, and still more specifically from about 0.85 to about 1.0 millimeters. The use of multiple shute diameters and modified weave structures enable rippled channel depths (hereinafter defined) from about 250 to about 350 percent of the warp strand diameter, more specifically from about 260 to about 300 percent of the warp strand diameter, or from about 105 to about 125 percent of the sum of the warp and weighted-average shute diameters.

Figure 4:
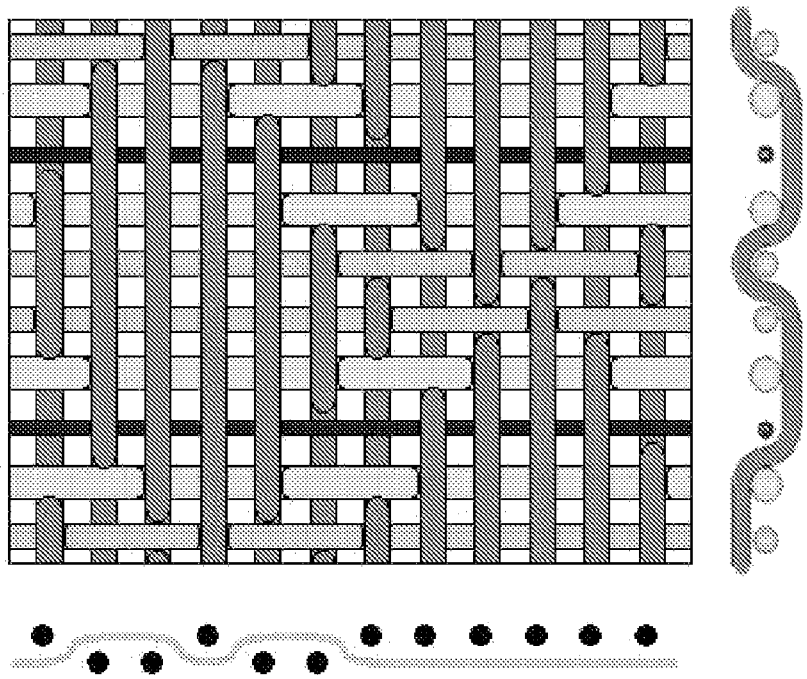
FIG. 4 illustrates the t1207-12 weave pattern of the present invention and shows the specific locations of the differing diameter shutes used to produce the deep, rippled structure.

FIG. 4 illustrates the t1207-12 weave pattern of a papermaking fabric of the present invention and shows the specific locations of the differing diameter shutes used to produce a deep, rippled structure. The image at the bottom of FIG. 4 is a z-direction representation of the shute path of the bottom (nearest) shute in the weave pattern. The shute, depicted by the line, passes under 1 warp, depicted by a dot, over 2 warps, under 1 warp, over 2 warps, and under 6 warps before repeating. For this particular shute, there are 4 interlacings where the shute and warp change orientation with respect to each other. The image at the right hand side of FIG. 4 is a z-direction representation of the warp path of the right-hand (nearest) warp in the weave pattern. The warp, depicted by the line, passes over 2 shutes of differening diameters, depicted by dots of differing diameters under 3 shutes again of differing diameter, over 1 shute, under 3 shutes, and over 1 shute in the unit weave repeat. The longest warp float that this warp end makes is over-3-shutes across two repeats of the weave pattern. For this particular warp, there are 4 interlacings where the shute and warp change orientation. It can be seen in FIG. 4 that the warp end two yarns away over passes 9 shutes and under 1 shute. This is the longest, over-9-shute warp float of the t1207-12 weave pattern.

Figure 5:
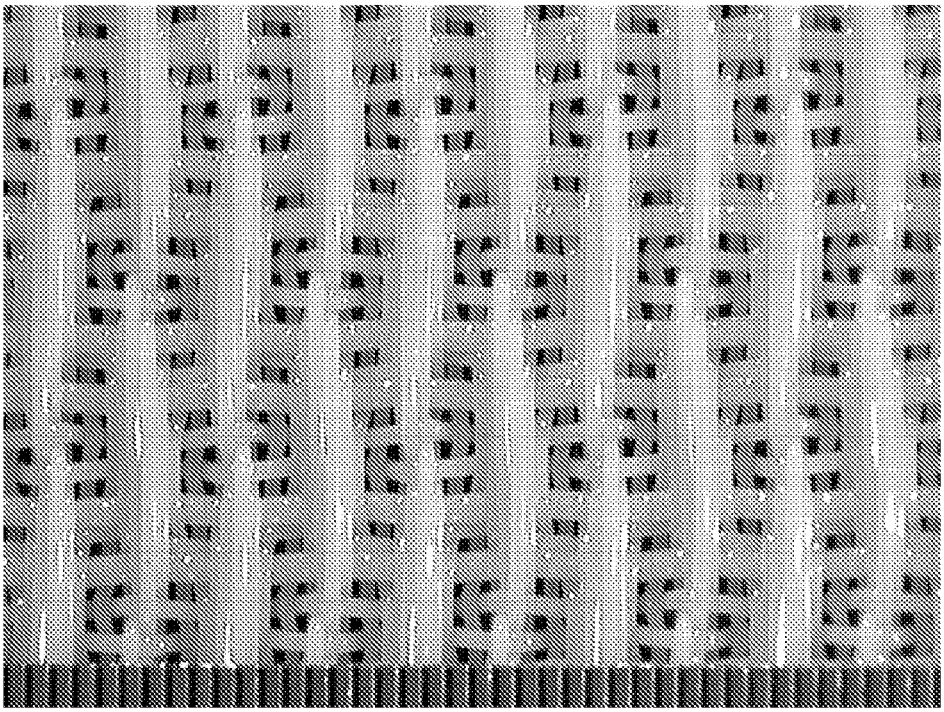
FIG. 5 is a plan view photograph of the tissue contacting side of a Jack (t1207-12) papermaking fabric of the present invention.

FIG. 5 is a plan view photograph of the tissue contacting side of the resultant inventive fabric Jack (t1207-12). In the t1207-12 weave structure, the longest warp float is over nine (9) shutes. Three different shute diameters are utilized, two of which are larger than the warp diameter along with a smaller, stuffer yarn located between pairs of large shutes. The shute paths, with respect to interlacings with the warps, of the stuffer yarns differ from the shute paths of the adjacent large shutes and pass on top of, or over, two warps within each of the fabric valleys. Like Fred (t1207-11), the Jack (t1207-12) fabric is a single layer structure in that all warps and shutes participate in both the sheet-contacting side of the fabric as well as the machine side of the fabric.

Specific characteristics of the Jack fabric are included in Table 1. The fabric is warp dominant, with the top plane corresponding to the highest warp floats rising 115% of the warp diameter above the intermediate plane corresponding to the highest shutes.

The fabric weave pattern is labeled t1207-12 whereas the description Jack in Table 1 includes additional information about the weaving conditions, raw material dimensions and properties, heatsetting instructions. For example, the shute material can be made of either standard high temperature polyester used for TAD fabrics, as shown, a modified heat-, wear- and/or contaminant-resistant polyester, or a hydrolysis resistant material such as polyphenylene sulfide. The diameters of the individual shute strands and their cross-sectional shape can also change. For example, reducing the largest shute will improve tissue fiber support while reducing the rippled channel height: Voith Fabrics' fabric Lilo (t1207-12) is one such fabric. Alternatively, increasing selected shute diameters can increase the rippled channel height.

Versus the Fred design, the Jack fabric can be woven at an increased pick count to improve fiber support while yielding the same or slightly higher warp float length (7.0 mm for the longest warp float in Jack vs 6.6 mm for the longest warp float length in Fred) because the longest warp floats now pass over nine (9) instead of seven (7) shutes. Jack also offers an increased ripple channel depth available for molding, even at higher pick counts (0.967 mm at 32 pick vs 0.879 mm for Fred at 27 pick and 0.720 mm for Jetson at 36 pick). And the selective application of stuffer yarns at specific locations in the fabric structure improves the fiber support in these areas. As a result, Jack can provide acceptable fiber support for lightweight tissue grades, say 17 gsm, which can not be effectively or fully molded into the Fred fabric.

Figure 6:
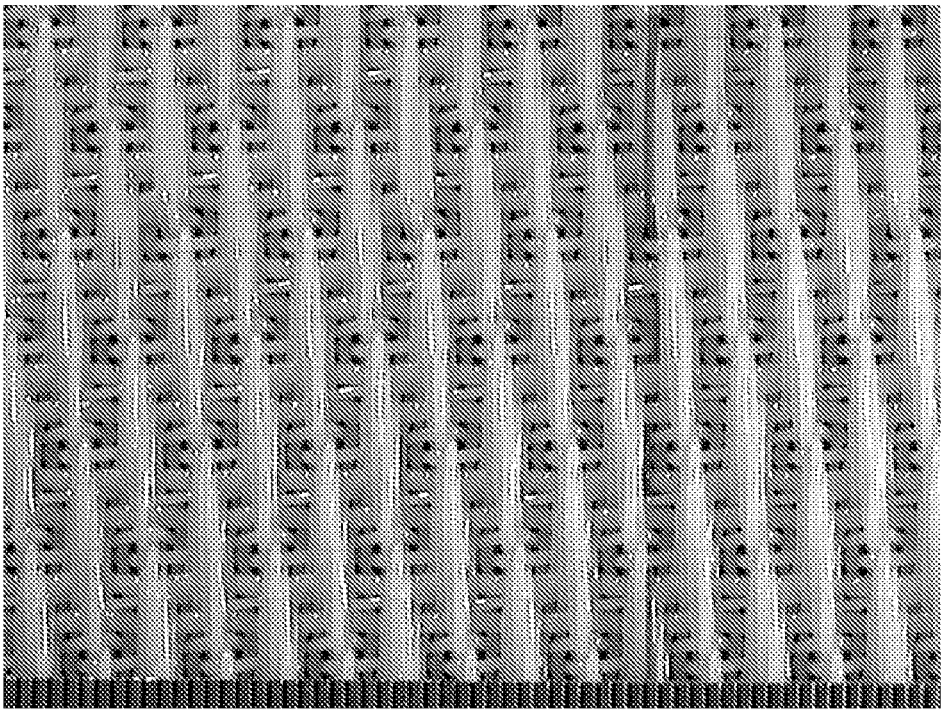
FIG. 6 is a plan view photograph of the tissue contacting side of inventive fabric pdf1539-47 illustrating an angled ripple and valley structure.

FIG. 6 is a plan view photograph of the tissue contacting side of inventive fabric pdf1539-47, illustrating an angled ripple structure. The fabric ripples are substantially continuous, not discrete, and formed of multiple warp strands grouped together and supported by multiple shute strands of three different diameters. Similar structures can be constructed using shute strands of at least two diameters. The warp strands are substantially oriented in the machine direction and each individual warp strand participates in both the structure of ripples and the structure of valleys.

For the fabric shown in FIG. 6, the fabric ridges and valleys are oriented at an angle of about 5 degrees relative to the true machine direction of the sheet. The angle is a function of both weave structure and pick count. Higher pick counts will increase the angle away from the true machine direction of the fabric. When used as an impression fabric for creped tissue making processes, the angle of the resulting tissue ridges and valleys may be foreshortened due to the speed differential between the Yankee dryer and the reel. The foreshorted angle can be calculated as described in U.S. Pat. No. 5,832,962 entitled "System for Making Absorbent Paper Products", granted Nov. 10, 1998, which is herein incorporated by reference. By way of example, for a creping process in which the web is wound up at a speed 20% slower than the Yankee speed, the resultant, foreshorted angle of the Yankee-side tissue ridge would be 12 degrees for the fabric shown in FIG. 6.

Figure 7:
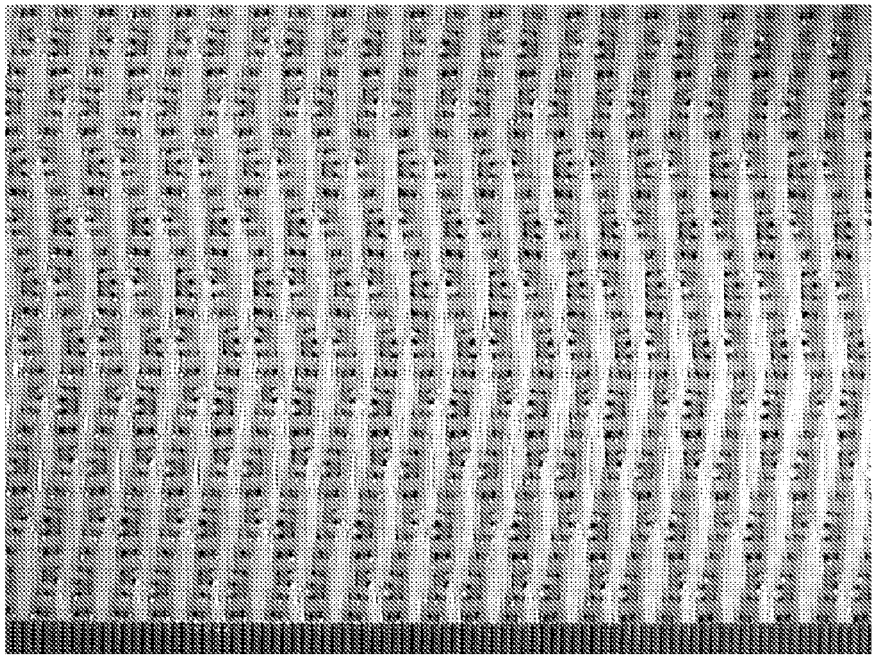
FIG. 7 is a plan view photograph of the tissue contacting side of inventive fabric Kanga (t1207-13), illustrating a wavy otherwise back-and-forth angled rippled and valley structure.

FIG. 7 is a plan view photograph of the tissue contacting side of inventive fabric Kanga (t1207-13), illustrating the weave pattern and specific locations of the different diameter shutes used to produce the deep, wavy rippled structure. In this structure, the longest warp float is over seven (7) shutes and two different shute diameters are utilized, both of which are larger than the warp diameter even though this is not a requirement of the fabric structure. The fabric ripples are substantially continuous but aligned along a slight angle (up to 15 degrees) with respect to the machine direction. The ripples are higher and wider than individual warp strands and individual warp strands participate in both the fabric ripple and the fabric valley due to the warp strands being substantially oriented in the machine direction. The angle of the fabric ripples regularly reverse direction in terms of movement in the cross-machine direction, creating a wavy rippled appearance which can enhance tissue aesthetics or reduce the tendency for adjacent layers of tissue to nest along the ripple structure. For creped applications the wavy ripple also serves to alternate the locations along the Yankee dryer surface to which the tissue web is adhered. In the fabric shown, the ripple reverses direction after traversing approximately one-half of the cross-machine spacing between the ripples.

Figure 8:
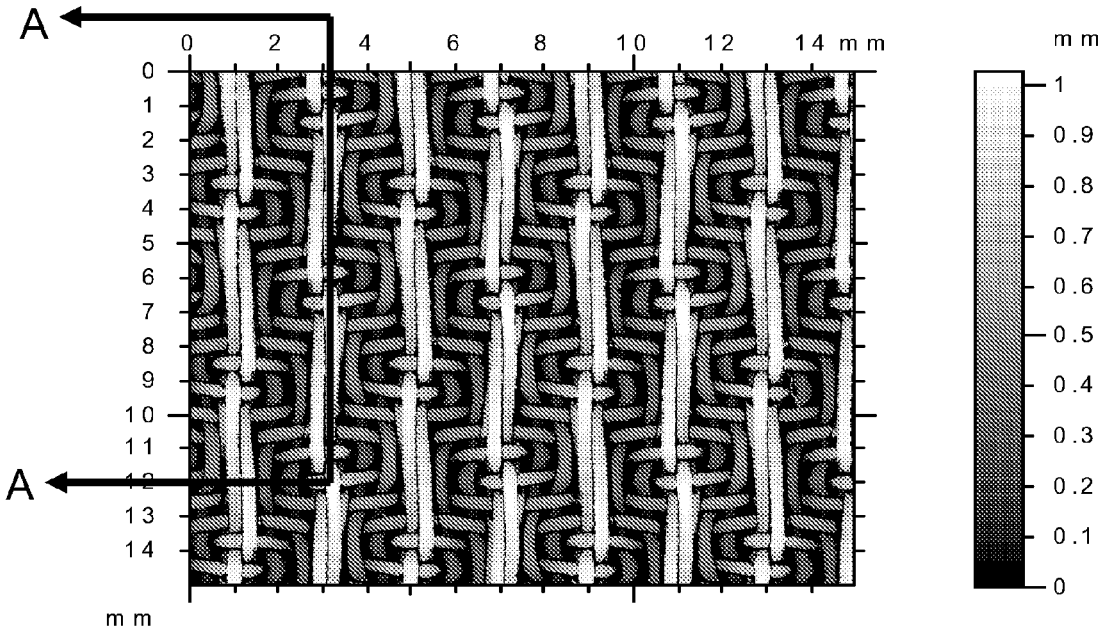
FIG. 8 is a surface profile map of fabric Jetson (t1207-6) obtained with a non-contacting, optical surface profilometer.

FIG. 8 is a surface profilometry map, or studiable, of prior art fabric Jetson (t1207-6). This map was generated within the TalyMap software based on the raw data provided by the MicroProf optical profilometry equipment. The image has been cleaned and zoomed to show at least one unit repeat of the weave pattern. The studiable shows z-directional depths via a greyscale or color gradient, with darkness increasing with increased distance away from the top plane of the fabric.

Figure 9:
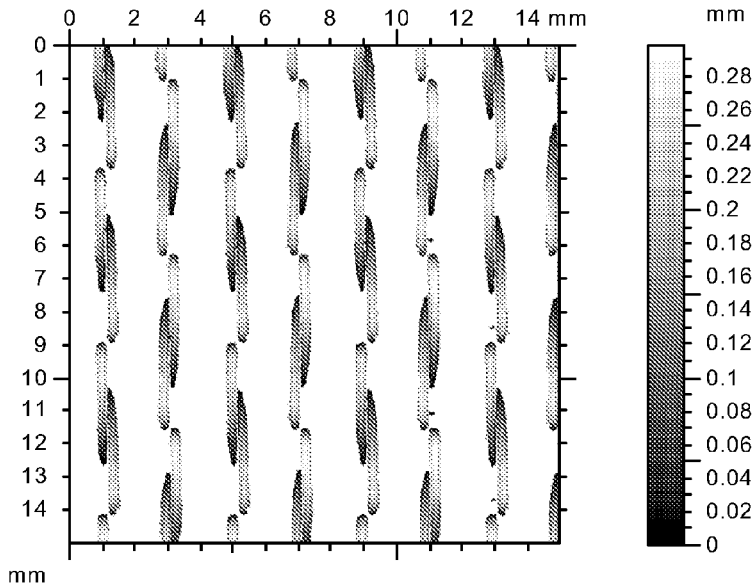
FIG. 9 is a resultant surface profile map of the Jetson (t1207-6) fabric after the fabric has been thresholded to the intermediate plane.

FIG. 9 is a resultant surface profile map of the Jetson (t1207-6) fabric after the fabric has been thresholded to the intermediate plane. Large areas which are white are below the intermediate plane, having been treated as non-measured points during the thresholding operation. Only elements raised above the intermediate plane are therefore shown in the image.

Tracing along a machine direction ripple, the thresholded profile shows essentially only one of the two longest warp floats (over-7-shutes) are raised at any given location in the Jetson structure, with a given warp float fading into the body of the fabric while its adjacent long float rises to the surface. The threshold level of FIG. 9 was arbitrarily chosen to coincide with the intermediate plane as defined by Chiu et al. in U.S. Pat. No. 5,429,686 in order to expand the greyscale scale for illustrative purposes. These same results are obtainable, but not as easily distinguished, when the fabric is thresholded to the rippled channel depth (0-0.720 mm, see FIG. 15) or from the original surface profile map of FIG. 8.

Figure 10:
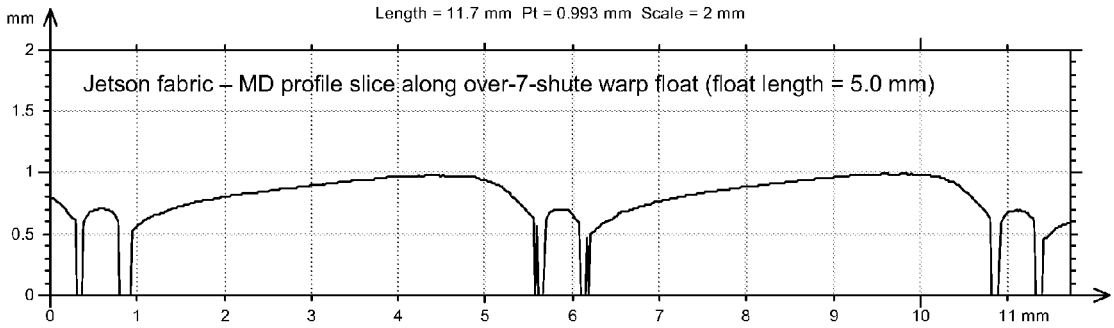
FIG. 10 is a two-dimensional extracted profile obtained from the original three-dimensional studiable along line A-A of FIG. 8 for the Jetson (t1207-6) fabric.

FIG. 10 is a two-dimensional extracted profile obtained from the original three-dimensional studiable along line A-A in FIG. 8 for the Jetson fabric. The profile slice has been taken in the machine direction along the centerline of one of the highest machine direction warps in the Jetson fabric. The x-axis shows physical dimensions in the machine direction whereas the y-axis represents the z-direction height from the bottom surface of the profile. Heights in FIG. 10 are relative and not necessarily measured from the bottom, non-sheet contacting surface of the fabric since they depend on how the initial image has been cleaned to establish a meaningful z-direction scale. The profile slice shows the upper half of three 0.4 mm shutes which pass over and anchor the long warp floats (centerlines at about x=0.6, 5.85, and 11.1 mm) as well as two long warp floats approximately 5.0 mm in length (from x=0.8-5.5 and x=6.1-10.9).

This profile slice serves to indicate the z-directional curvature of the long warp floats of the Jetson fabric. Such curvature can offer several disadvantages: these areas of the warp strands are more exposed to wear from sheet-contacting-side stationary papermachine elements such as air knives and when used in uncreped through air dried processes can increase surface roughness variation on the air-side of the resulting tissue web. When used as impression fabrics or TAD fabrics in creped applications, where the fabric and tissue pass through the pressure-roll/Yankee nip, these yarns suffer increased mechanical damage (fibrillation) in the proudest area during the cyclical compaction. Furthermore, fabric sanding is required to ensure a continuous, machine direction contact to the Yankee for the tissue located along the fabric ripple and additional sanding passes are required during the fabric manufacturing process to improve the fabric contact area as well as contact pattern. The inventive fabrics reduce these potential issues by reducing the z-directional curvature of the long warp floats by changing the underlying shute structure at selected locations along the fabric ripple.

Figure 11:
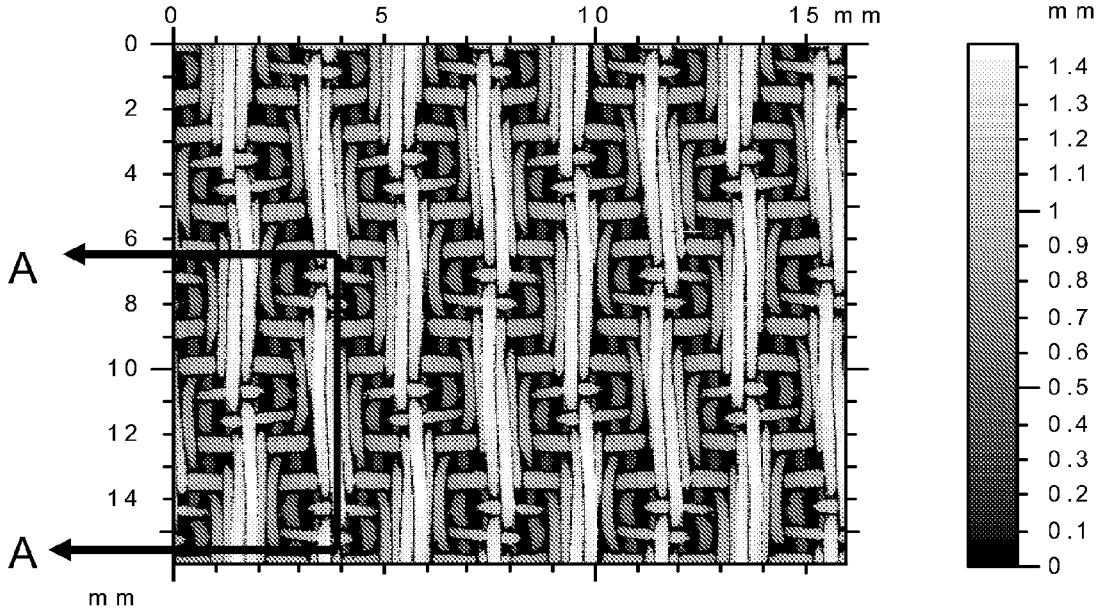
FIG. 11 is a surface profilometry map, or studiable, of the sheet contacting side of inventive fabric Fred (t1207-11)

FIG. 11 is a surface profilometry map, or studiable, of the sheet contacting side of inventive fabric Fred (t1207-11). The larger z-direction greyscale range for Fred vs. FIG. 8 for Jetson is due to both a greater overall fabric caliper and larger topography variability between the fabric ripples and valleys. The highest warps along the fabric ripple tops are also the longest warp floats, namely over-7-shute warp floats.

Figure 12:
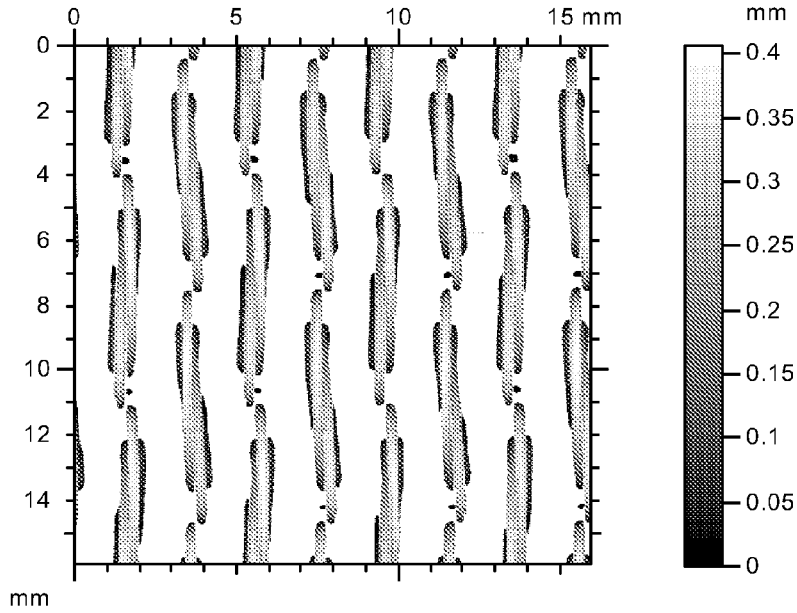
FIG. 12 is a resultant surface profile map of the Fred (t1207-11) fabric after the fabric has been thresholded to the intermediate plane.

FIG. 12 is a resultant surface profile map of the inventive fabric Fred (t1207-11) after the fabric has been thresholded to the intermediate plane. In contrast to FIG. 9, this profile shows that both of the long, over-7-shute warp floats significantly contribute to defining the top structure of the fabric ripples. The introduction of larger diameter shutes into selected spots in the fabric ripple structure have lengthened the elevated section of the longest floats as well as their adjacent over-5-shute warp floats (parts of which are just barely distinguishable as they mostly lie below the longer over-7-shute warp floats in the z-direction). Changes in the shute structure underlying the fabric ripple tops has also affected the amount of warp crimping at the end of the long warp floats. In contrast to Jetson, the machine direction distance between the longest warp floats on adjacent warp strands has been reduced. This helps to improve the continuity of machine direction contact for creped tissue applications as shown in the next figure and makes fabric sanding an optional process step.

Figure 13:
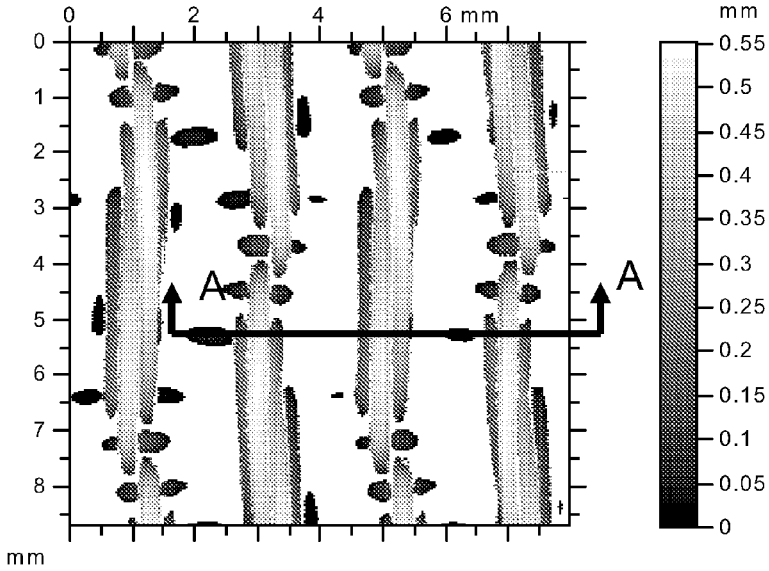
FIG. 13 is an additional thresholded profile map of the sheet contacting side of fabric Fred (t1207-11), taken at a level corresponding to the top of the largest, 0.6 mm diameter shute rather than the level of its 0.4 mm neighbor, the highest shute.

FIG. 13 is an additional thresholded profile of the sheet contacting side of fabric Fred (t1207-11), taken at a level corresponding to the top of the largest, 0.6 mm diameter shute rather than the level of its 0.4 mm neighbor, the highest shute. In the image, line A-A represents the location of the 0.6 mm large shute. Introduction of this large shute at this specific location causes the highest point of the warp to start directly above this location rather than at the end of the warp float, providing several benefits. The z-direction depth at the intermediate plane has increased from 0.29 mm for Jetson to 0.41 mm for Fred, which increases the overall ripple channel depth available for molding and therefore the resultant tissue bulk. MD continuity of contacting points at the end of the long warp floats is also enhanced. Because there are several large shutes underlying the longest warp floats, they elevate the whole float and effectively extend its length above the intermediate plane. This both increases the MD continuity of contact between overlapping warp floats on adjacent yarns and between the end of a warp float on one yarn to the start of a warp float on the adjacent wary, reducing or eliminating the need for fabric sanding. This also flattens the z-direction profile, which increases the amount of the warp in the top plane available for wear or mechanical removal during sanding. When subjected to a nip, this improves the total contact area.

Figure 14:
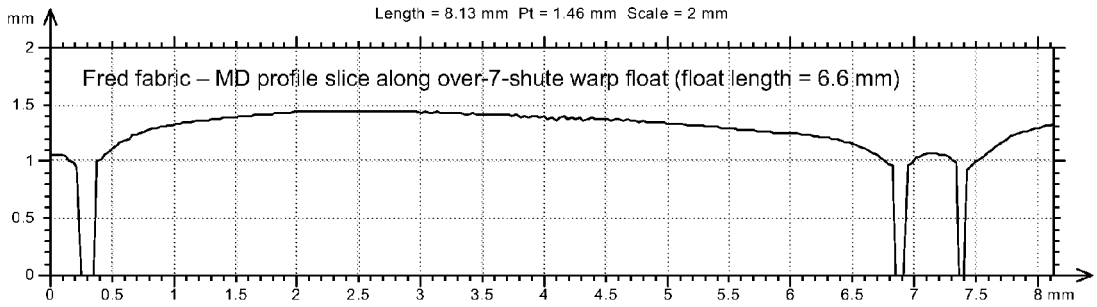
FIG. 14 is a two-dimensional extracted profile obtained from the original three-dimensional studiable along line A-A in FIG. 11 for the Fred (t1207-11) fabric.

FIG. 14 is a two-dimensional extracted profile obtained from the original three-dimensional studiable along line A-A of FIG. 11 for the Fred fabric. Like FIG. 10 for Jetson, the profile slice has been taken along one of the highest machine direction warps in the Fred fabric. This profile shows both the lengthening of the warp float as well as its reduced amount of z-direction curvature when contrasted to the equivalent Jetson profile slice. This improves the effectiveness of sanding in terms of the reducing the percentage of a warp diameter lost when sanding to a specific warp knuckle length.

Figure 15:
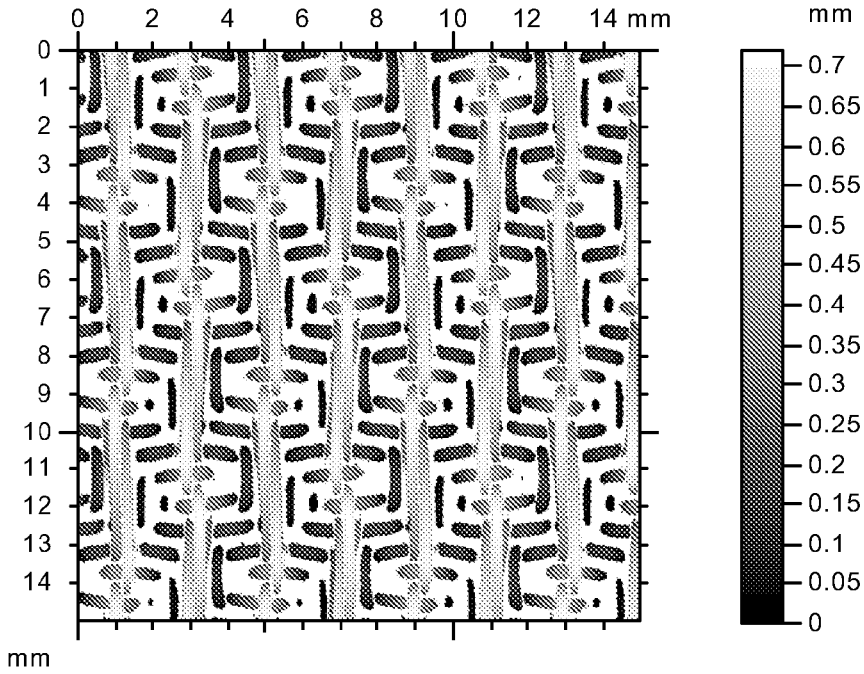
FIG. 15 is a resultant surface profile map of the sheet contacting side of the Jetson (t1207-6) fabric after the fabric has been thresholded to the valley bottom plane.

FIG. 15 is a resultant surface profile map of the sheet contacting side of the Jetson (t1207-6) fabric after the fabric has been thresholded to the valley bottom plane. The valley bottom plane is at the lowest visible, exposed knuckle, which in this case is an over-1-shute warp float in the center of one of two distinct fabric valleys which make up a unit weave repeat. The depth of the rippled channel, measured from the fabric top plane to the valley bottom plane, is approximately 0.720 mm.

Figure 16:
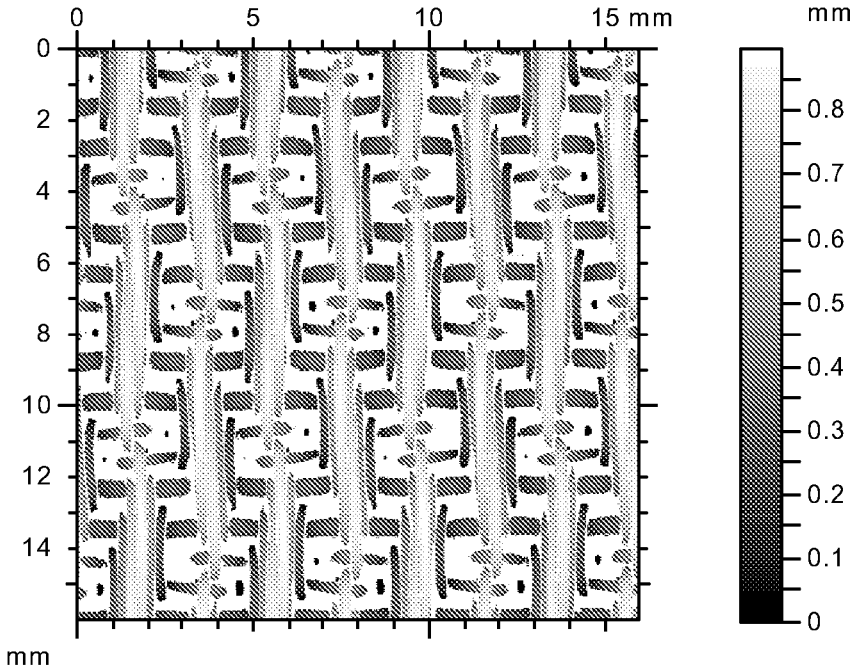
FIG. 16 is a resultant surface profile map of the sheet contacting side of the Fred (t1207-11) fabric after the fabric has been thresholded to the valley bottom plane.

FIG. 16 is a resultant surface profile map of the sheet contacting side of the Fred (t1207-11) fabric after the fabric has been thresholded to the valley bottom plane. The depth of the rippled channel is at least 0.8 mm, preferably approximately 0.85 to 1.0 mm, and more preferably approximately 0.879 mm, or about 266 percent of the warp strand diameter, or about 106 percent of the sum of the warp and weighted-average shute diameters.

The Fred surface map in FIG. 16 shows more overall fiber support potential from the fabric throughout the depth of the fabric valley than is shown in FIG. 15 for the Jetson fabric. There are more warp and shute strand surfaces still available to support tissue molded to this depth, which leads to more effective micro-scale molding in the MD and CD directions. Versus the Jetson structure, there are also fewer areas in which the topography rapidly changes depth moving from the top of the fabric ripples (say in the MD center of the longest warp floats) to the fabric valleys because the individual warps are not completely obscured from view by an adjacent warp having stacked upon it. This is desirable for reducing the probably of pinhole formation during molding into the highly topographic structure and one mechanism by which the fabric topography or rippled channel depths can be increased while still providing adequate fiber support.

Figure 17:
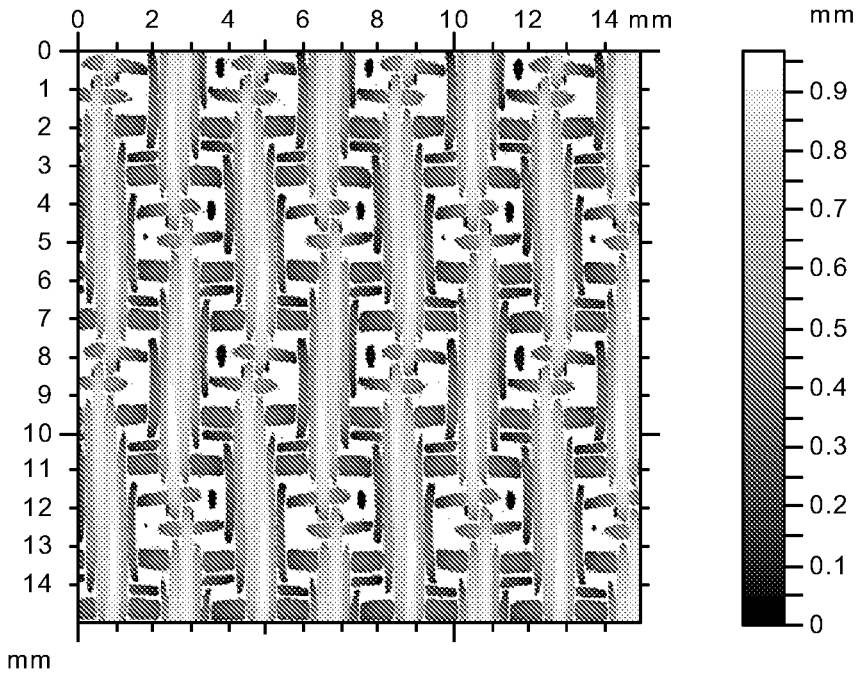
FIG. 17 is a resultant surface profile map of the sheet contacting side of the Jack (t1207-12) fabric after the fabric has been thresholded to the valley bottom plane.

FIG. 17 is a resultant surface profile map of the sheet contacting side of the Jack (t1207-12) fabric after the fabric has been thresholded to the valley bottom plane. The depth of the rippled channel is approximately 0.967 mm, or about 281 percent of the warp strand diameter, or about 117 percent of the sum of the warp and weighted-average shute diameters.

Figure 18:
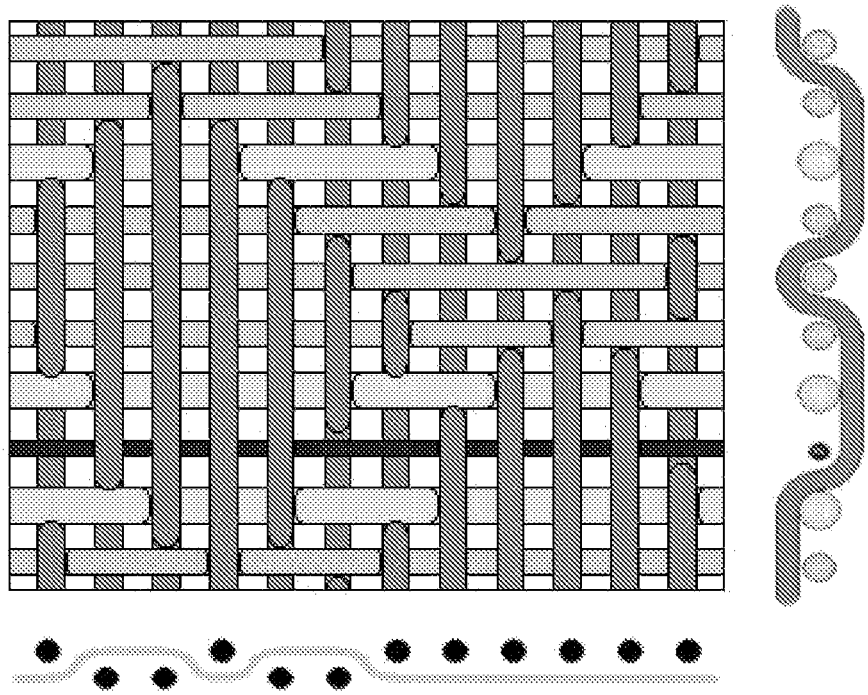
FIG. 18 illustrates the weave pattern for a further embodiment of the present invention which results a fabric having co-planar warps and shutes.

FIG. 18 illustrates a further embodiment of the present invention. As with FIGS. 4 to 5, the woven fabric will provide a sheet-contact topography of substantially continuous machine direction ripples separated by valleys. The resultant fabric ripples will be higher and wider than individual warp strands. In contrast to the warp-dominant rippled fabrics Fred and Jack, however, the weave shown will result in co-planar warps and shutes due to the inclusion of an additional shute. The resultant fabric can be co-planar or shute dominant depending on the diameter of the additional shute.

One would expect that fabric structures providing machine-direction ripples formed of multiple warp strands grouped together would necessarily be warp dominant structures, i.e., that the highest elements in the structures would only be warp strands. However, it is possible to construct such fabrics which are either co-planar or shute dominant. Co-planar fabrics have knuckle heights above the intermediate plane of less than 10% of the combined sum of average warp and shute diameters.

Figure 19:
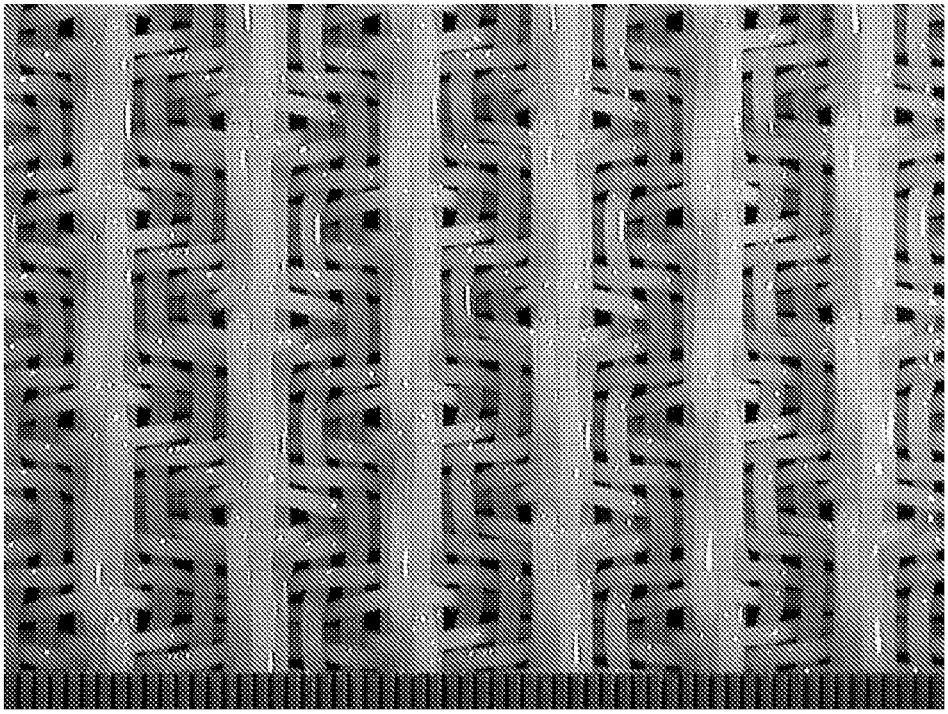
FIG. 19 is a plan view photograph of the sheet contacting side of an Elmer (t1203-6) papermaking fabric disclosed in U.S. Pat. No. 6,998,024 B2 to Burazin et al.

FIG. 19 is a plan view photograph of the sheet contacting side of an Elmer (t1203-6) papermaking fabric disclosed in U.S. Pat. No. 6,998,024 B2 to Burazin et al. Fabric features, include surface profilometry data, are provided in Table 1. The fabric is clearly warp dominant since the warp knuckle height above the intermediate plane formed by the highest shute knuckle is 0.466 mm, or 67% the warp diameter.

Figure 20:
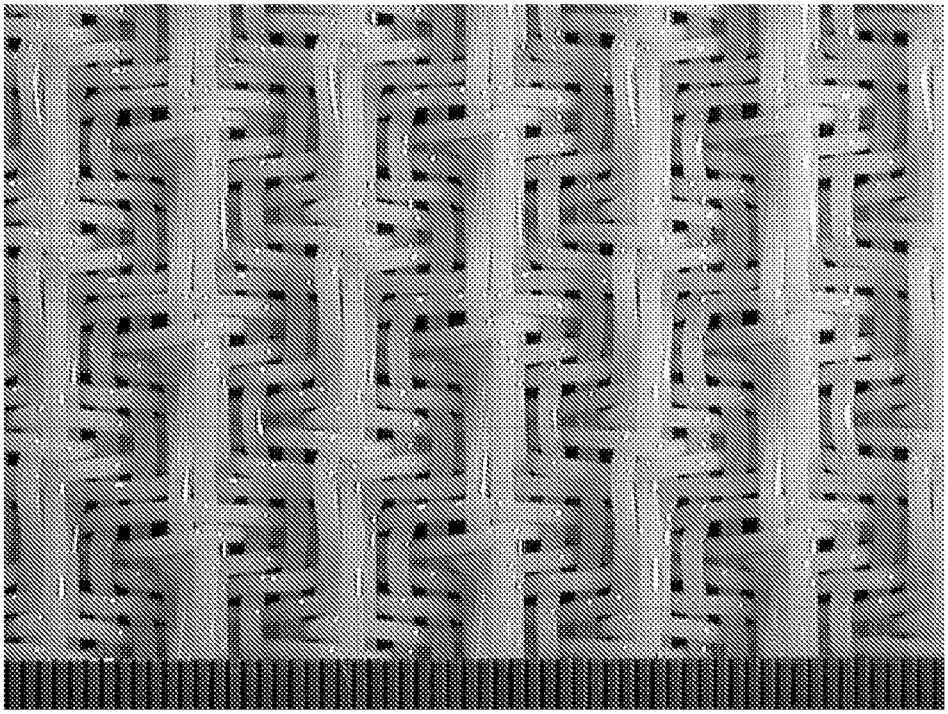
FIG. 20 is a plan view photograph of the sheet contacting side of an Ironman (t1203-8) papermaking fabric disclosed in U.S. Pat. No. 6,998,024 B2 to Burazin et al.

FIG. 20 is a plan view photograph of the tissue contacting side of an Ironman (t1203-8) papermaking fabric disclosed in U.S. Pat. No. 6,998,024 B2 to Burazin et al. Fabric features, include surface profilometry data, are provided in Table 1. The fabric contains co-planar warps and shutes, as defined previously, since the warp knuckle height above the intermediate plane is only 0.073 mm (obtained with a scan at 0.050 mm resolution), or 10% of the warp diameter. FIGS. 19 to 20 show how the weave structure of a papermaking fabric providing machine-direction ripples formed of multiple warp strands can be modified to reduce it from a warp dominant fabric to a co-planar structure. The weave pattern of FIG. 18 is a similar modification to the Jack fabric weave of FIG. 4 which will results in a coplanar fabric. Hence the fabrics of the present invention can be either warp-dominant or co-planar. The advantage of converting the inventive fabrics from a warp-dominant to a co-planar structure lie in improving the contact area and continuity of machine-direction contact with the Yankee dryer when such fabrics are used in modified wet-pressed or conventional through-air-dried processes where the fabric conveys the sheet to the Yankee dryer and transfers such web to the Yankee by passing through a nip.

The fabrics of the present invention also provide desirable tissue property improvements. Uncreped through air dried (UCTAD) tissue can be made according to the method disclosed in U.S. Pat. No. 5,672,248 to Wendt et al., which is hereby incorporated by reference, UCTAD bath tissue made with a Jetson transfer+Jetson TAD fabric combination yields approximately 18% CD strain and an average tissue ripple channel depth of 590 um. Measurement of CD strain is disclosed in US patent application US 2006/0090867 A1 to Herman et al., which is herein incorporated by reference. Actual strain levels were obtained from surface profilometry maps of the molded tissue. UCTAD issue made with a Jetson transfer+the inventive Jack TAD fabric combination yielded a 1.8% point increase in CD strain, to 19.8% and an average tissue ripple channel depth of 653 um. The rippled channel depths of the fabrics differed by 206 um, or directly similar but slightly larger than the actual bulk gain achievable with tissue molded into the different fabrics. The increase in CD strain is desirable for imparting improved CD tissue properties.

The fabrics of the present invention also offer improved ripple channel depth while maintaining adequate fiber support. For towel made on a conventional, creped through air dried tissue machine, such as disclosed in U.S. Pat. No. 6,039,838 to Kaufman & Herman, the Fred fabric resulted in a 12 percent increase in basesheet bulk, to 23 cc/g, versus towel wadding produced with the Jetson fabric. For bath tissue made on an uncreped through air dried tissue machine, such as disclosed in U.S. Pat. No. 5,672,248 to Wendt et al., at 17 gsm with a Jetson transfer+the inventive Jack TAD fabric combination provided acceptable pinhole levels similar to a Jetson transfer/Jetson TAD fabric package whereas a Jetson transfer/Fred TAD fabric package resulted in unacceptable pinholes.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A woven fabric for a papermaking machine, said fabric comprising a textured sheet contacting surface having substantially continuous machine-direction ripples separated by valleys, said ripples being formed of multiple warp strands grouped together and supported by multiple shute strands of two or more diameters, the fabric being a single layer fabric and having a cross-machine direction bending stiffness from about 20 to about 80 N·m.

2. The fabric of claim 1, wherein said ripples have a width of between approximately 1.3 to 3 mm.

3. The fabric of claim 1, wherein said ripples have a frequency of occurrence in a cross-machine direction of the fabric of between approximately 2 to 8 ripples per centimeter.

4. The fabric of claim 1, wherein said ripples comprise multiple individual warp strands substantially oriented in a machine direction, said ripples being wider than the individual warp strands.

5. The fabric of claim 1, wherein said ripples comprise multiple individual warp strands substantially oriented in a machine direction, said ripples being higher than the individual warp strands.

6. The fabric of claim 1, wherein said ripples comprise multiple individual warp strands substantially oriented in a machine direction, said ripples being wider and higher than individual said warp strands.

7. The fabric of claim 1, wherein said ripples comprise multiple individual warp strands substantially oriented in the machine direction and wherein at least one warp strand participates exclusively in a structure of a ripple.

8. The fabric of claim 1, wherein said ripples comprise multiple individual warp strands substantially oriented in a machine direction, and wherein at least one said warp strand participates exclusively in a structure of at least one said valley.

9. The fabric of claim 1, wherein said ripples comprise multiple individual warp strands substantially oriented in a machine direction, and wherein no individual said warp strand concurrently participates in a structure of at least one said ripple and participates in a structure of at least one said valley.

10. The fabric of claim 1, wherein each individual warp strand concurrently participates in both the structure of said ripples and the structure of said valleys.

11. The fabric of claim 1, wherein said ripples comprise multiple individual warp strands substantially oriented in a machine direction, and wherein each individual warp strand concurrently participates in both the structure of said ripples and the structure of said valleys.

12. The fabric of claim 1, wherein said fabric is warp-dominant.

13. The fabric of claim 1, wherein said fabric is co-planar.

14. The fabric of claim 1, wherein said ripples have a depth of at least 0.8 mm.

15. The fabric of claim 14, wherein said ripples have a depth of between approximately 0.85 to 1.0 mm.

16. A woven papermaking fabric having a textured sheet contacting surface comprising substantially continuous machine-direction ripples separated by valleys, said ripples being formed of multiple warp strands grouped together, said ripples having a depth of between approximately 250 to 300 percent of a warp strand diameter, the fabric being a single layer fabric and having a cross-machine direction bending stiffness from about 20 to about 80 N·m.

17. The fabric of claim 16, wherein said ripples having a width of less than 3 mm.

18. The fabric of claim 16, wherein said ripple depth is between approximately 105 to 120 percent of a sum of the warp and weighted-average shute diameters.

19. The fabric of claim 16, wherein said fabric comprises a forming fabric for use in a wet-laid papermaking process.

20. The fabric of claim 16, wherein said fabric comprises a through-air-drying fabric for use in a wet-laid papermaking process.

21. The fabric of claim 16, wherein said fabric comprises a transfer fabric.

22. The fabric of claim 16, wherein said fabric is configured for imparting a cross-machine direction molding strain of about 20 to 25 percent.

23. The fabric of claim 16, wherein said fabric is one of an impression and through-air-drying fabric for conveying a web through a pressure-roll nip to a Yankee dryer in a wet-laid papermaking process.

24. The fabric of claim 23, wherein, wherein said impression fabric has a frequency of occurence of the fabric ripples, and is configured for contacting the Yankee dryer in substantially continuous machine-direction bands with a frequency of occurence corresponding to said frequency of occurence of the fabric ripples.

25. The fabric of claim 23, wherein said fabric includes a post-treatment in the form of sanding to improve contact area.

26. A single layer, woven fabric having at least 40 features per square inch, and a textured sheet contacting surface having a z-direction depth of at least 0.8 mm, the fabric being a single layer fabric and having a cross-machine direction bending stiffness from about 20 to about 80 N·m.

27. The fabric of claim 26, having warp strands with respective diameters less than 0.4 mm.

28. The fabric of claim 26, having a z-direction depth greater than a diameter of an individual warp strand.

29. A woven papermaking fabric having a textured sheet contacting surface comprising substantially continuous ripples aligned at an angle to a machine direction and separated by valleys, said ripples being formed of multiple warp strands grouped together and supported by multiple shute strands of two or more diameters, wherein the warp strands are substantially oriented in the machine direction and wherein each individual warp strand participates in both a structure of said ripples and a structure of said valleys, the fabric being a single layer fabric and having a cross-machine direction bending stiffness from about 20 to about 80 N·m.

30. A woven papermaking fabric having a textured sheet contacting surface comprising substantially continuous ripples aligned at a variable angle to a machine direction and separated by valleys, said ripples being formed of multiple warp strands grouped together and supported by multiple shute strands of two or more diameters, wherein the warp strands are substantially oriented in the machine direction and wherein each individual warp strand participates in both a structure of said ripples and a structure of said valleys, and wherein said variable angle of said fabric ripple regularly reverses direction in terms of traversing the cross-machine direction to thereby create a wavy-like appearance, the fabric being a single layer fabric and having a cross-machine direction bending stiffness from about 20 to about 80 N·m.

* * * * *